US008348866B2

(12) United States Patent
Tudico

(10) Patent No.: US 8,348,866 B2
(45) Date of Patent: Jan. 8, 2013

(54) DEVICE FOR TREATING, IN PARTICULAR MASSAGING, THE CONNECTIVE TISSUE OF THE SKIN

(75) Inventor: Gianfranco Tudico, Bourg-les-Valence (FR)

(73) Assignee: Neavia Technologies, Creteil (FR)

( * ) Notice: Subject to any disclaimer, the term of this patent is extended or adjusted under 35 U.S.C. 154(b) by 990 days.

(21) Appl. No.: 12/305,587

(22) PCT Filed: Jun. 18, 2007

(86) PCT No.: PCT/FR2007/001008

§ 371 (c)(1),
(2), (4) Date: Feb. 18, 2009

(87) PCT Pub. No.: WO2007/147964

PCT Pub. Date: Dec. 27, 2007

(65) Prior Publication Data

US 2010/0010401 A1 Jan. 14, 2010

(30) Foreign Application Priority Data

Jun. 19, 2006 (FR) ..... 06 05423

(51) Int. Cl.
*A61H 7/00* (2006.01)
*A61H 15/00* (2006.01)

(52) U.S. Cl. ..... 601/7; 601/6; 601/122

(58) Field of Classification Search ..... 601/6, 7, 601/8, 9, 10, 11, 118–122, 125–127, 133, 601/134, 135; 15/344, 345, 384
See application file for complete search history.

(56) References Cited

U.S. PATENT DOCUMENTS

| | | | | |
|---|---|---|---|---|
| 5,891,064 | A * | 4/1999 | Van Herk et al. | 601/126 |
| 6,090,055 | A * | 7/2000 | Frajdenrajch | 601/7 |
| 6,312,396 | B1 * | 11/2001 | Muller | 601/6 |
| 6,517,499 | B1 * | 2/2003 | Pereira | 601/7 |
| 6,702,766 | B2 * | 3/2004 | Guitay | 601/6 |

FOREIGN PATENT DOCUMENTS

| | | |
|---|---|---|
| DE | 485963 | 11/1929 |
| DE | 4314362 | 11/1994 |
| EP | 0224422 | 6/1987 |
| EP | 0916330 | 5/1999 |
| FR | 1124229 | 10/1956 |
| FR | 2057514 | 5/1971 |
| GB | 395302 | 7/1933 |

OTHER PUBLICATIONS

International Search Report Received in PCT Applicaiton No. PCT/FR2007/0010008; Dec. 17, 2007.

* cited by examiner

*Primary Examiner* — Quang D Thanh
(74) *Attorney, Agent, or Firm* — Advantedge Law Group

(57) ABSTRACT

This device may include two parallel rollers which work the skin and which are mounted in a casing so as to rotate about their respective axis. To reliably and effectively treat skin by aspiration, without using excessive vacuum levels, at least one of the rollers may be hollow and delimit transverse aspiration passages. These passages may have an outer end, which opens out on the periphery of the roller, and an inner end which, when the outer end is directed towards the skin, is connected to a vacuum source via a control means inside the roller. These passages may be distributed about the periphery of the roller such that, for each position of the roller, at least one passage has its outer end directed towards the skin and its inner end in fluidic communication, via the control means, with the inner end of at least one other of the passages.

12 Claims, 9 Drawing Sheets

DEVICE FOR TREATING, IN PARTICULAR MASSAGING, THE CONNECTIVE TISSUE OF THE SKIN

The present invention relates to a device for treating, in particular massaging, the connective tissue of the skin of a subject, associated with a vacuum source.

The invention relates in particular to the devices that make it possible to perform a massage of "rolling" type, that is, a massage that is used to treat the connective tissue of cutaneous areas and which involves exerting on a subject a continuous action during which a localized pinching of the skin and also a progressive displacement of the pinched area of skin must both be performed simultaneously, so as to provoke a "rolling" of the skin while exerting a pressure.

Conventionally, the "rolling" massages are performed by hand, which ultimately tires the masseur. In addition, the massage treatments performed in this way are not very uniform, since they depend on the level of the stresses exerted by the masseur, and on the state of tiredness of the latter.

To overcome these drawbacks, EP-A-0 224 422 and EP-A-0 916 330 have proposed massage devices, which can be operated manually and make it possible to perform in particular "rolling" massages. Each of these devices comprises a casing inside which two rollers to work the skin are mounted to rotate about their axis, while a partial vacuum is created in a treatment chamber, arranged between and above the rollers. In service, when the rollers are applied against the skin of a subject and they rotate on themselves, the partial vacuum provokes, by aspiration, the formation of a fold of skin between the rollers, while bringing the rollers closer together in order to pinch the fold of skin that is formed. It will be understood that the effectiveness of this device depends largely on the quality of the seal between the periphery of the rollers and the skin being worked by these rollers: if this seal is inadequate, the aspiration between the rollers will not make it possible to fold the skin, except by increasing the level of vacuum in the treatment chamber. However, in this case, the rollers become difficult to rotate, which makes them skid or slip against the skin, and the fold of skin is treated with such an intensity that the massage rapidly becomes painful to the subject, or even incompatible with certain skin types, for example fragile, damaged or scarred skin.

Moreover, DE-A-43 14 362 and GB-A-395 302 have proposed simpler devices than those discussed hereinabove, inasmuch as they comprise only a single massage roller, freely rotating on a hollow shaft extended by a handle. This single roller is pierced with transverse aspiration passages, which all open out internally in the shaft, by which they are connected to a vacuum source. In operation, the skin of a subject is thus aspirated when the roller rolls over it. Because of their rudimentary structure, recalling that of a paint application roller, these devices are not very pleasant and their use of the vacuum makes it possible to work the skin of a subject only locally, in direct line with the roller, without performing a "rolling" type mobilization.

The aim of the present invention is to remedy the drawbacks outlined above, by proposing an innovative and beneficial treatment device, which acts by aspiration on the skin of a subject in a reliable and effective manner, without recourse to excessive vacuum levels.

To this end, the subject of the invention is a device for treating, in particular massaging, the connective tissue of the skin of a subject, associated with a vacuum source, comprising two parallel rollers to work the skin of the subject, mounted in a casing to rotate about their respective axis, characterized in that at least one of the rollers is hollow and delimits aspiration passages transverse to the axis of the roller, these aspiration passages each having an outer end opening out on the periphery of the roller, and an inner end adapted, at least when, during the rotation of the roller, the outer end of the passage is directed towards the skin being worked by the roller, to be connected to the vacuum source by a control means with which the roller is internally fitted and which is borne by the casing, and these aspiration passages being distributed on the periphery of the roller so that, for each position of the roller about its axis, at least one of the aspiration passages has its outer end directed towards the skin being worked by the rollers and has its inner end placed in fluidic communication by the control means with the inner end of at least one other of the aspiration passages, the outer end of which opens out into a free volume defined inside the casing.

According to the invention, the roller provided with aspiration passages, which in practice is the case for the two rollers of the device, plays an active role in grasping by aspiration the skin immediately it is in contact with the periphery of the roller; when the outer end of one of these aspiration passages is applied against the skin of a subject, this passage locally aspirates the skin, provided that the outer end of this passage is connected to the vacuum source. It will be understood that these rollers can be qualified as aspirating rollers, in particular compared to the rollers with full surface used in the prior art, in particular in EP-A-0 224 422 and EP-A-0 916 330. Furthermore, the vacuum supplied by the source circulates, thanks to the control means, both in the aspiration passages opening out onto the skin and in other passages to form a vacuum in the free volume of the casing. This free volume can thus form all or part of a treatment chamber, in particular between the rollers, and/or a space for the vacuum to circulate in the casing as far as an area of the casing where the connection to the vacuum source is fairly unstressful, and in particular less objectionable for the person manipulating the casing. In other words, the presence inside the casing of this free volume fed with vacuum gives the device a flexibility of use and noteworthy practical performance characteristics. Inasmuch as, in service, the aspiration rollers revolve on themselves, it will be understood that a given area of the skin to be treated can thus first be worked by the periphery of the roller, by being locally aspirated at the outer ends of the aspiration passages, then be subjected to a treatment, in particular a pinching and/or an aspiration, in the space between the two rollers, such as a treatment of "rolling" type. Thus, independently of the treatment applied to the area of skin between the rollers, the connective tissue of the skin is treated by aspiration either side of this area of skin in a direction substantially perpendicular to the axes of the rollers, which in practice corresponds to the direction of advance of the device along the skin. The skin is thus treated over a large extent, which, in practice, is the distance between the rollers separating their periphery, plus approximately the radius of each roller provided with the aspiration passages.

Since the skin is effectively gripped by aspiration from first contact with the rollers, a moderate vacuum level is sufficient to allow for an active but gentle treatment of the connective tissue of the skin, thus limiting the risks of pain to the subject and allowing for the use of the device according to the invention on fragile skins, such as scarred skins. Similarly, since the skin is held pressed against the aspirating rollers, it is prevented from bunching between the rollers, while being slightly tautened either side of each roller, by aspiration effect. Thus, the device according to the invention makes it possible to retighten the connective tissue, in the manner of a cutaneous stretching, and can even be applied effectively on very loose skin, following, for example, an abrupt slimming of the subject being treated.

Furthermore, the aspiration of the skin through the rollers prevents the latter from slipping or skidding against the skin as the device is displaced, given that the low vacuum level needed to operate the device induces only a moderate resistance against displacing the device against the skin, which facilitates the handling of this device. In particular, even if the skin has surface irregularities or sloping areas, the rollers effectively maintain their contact with the skin which can thus be agreeably subjected to the treatment provided between these rollers.

In practice, a number of embodiments can be envisioned for the rollers of the device according to the invention.

According to a first embodiment, said at least one or each roller comprises longitudinal bars parallel to the axis of the roller and distributed around the periphery of the roller, being spaced apart from each other in such a way as to form between them the aspiration passages.

According to this embodiment, the bars segment the periphery of the roller, so that the skin is gripped by aspiration between two adjacent bars, forming a thin fold, where the epidermis is worked, in particular its fibroblasts, the stimulation of which favors the smooth and retightened appearance of the skin. When the rollers are driven to rotate on themselves, these bars induce an effect of blows on the skin, which reinforces the cutaneous stretching effect.

According to a second embodiment, said at least one or each roller comprises a tubular sleeve centered on the axis of the roller and pierced with orifices forming the aspiration passages, these orifices extending substantially radially to the axis of the roller and being distributed in the axial dimension of the sleeve.

According to this second embodiment, the skin is gripped by the roller along a succession of one-off areas which correspond to the outer ends of the passages, distributed over the length of the sleeve. In other words, the skin is gripped by the roller in a cellular configuration, guaranteeing a soft aspiration action on a wide extent of skin, which respects the underlying tissues, in the sense that the aspiration of the skin involves no congestion or distortion of the connective fibers. This cellular grip makes it easier to orient the massage device in all directions, without damaging fragile skins, such as skins scarred or traumatized following burns.

Other characteristics of the massage device, taken in isolation or according to all the technically possible combinations, are set out in the dependent claims 4 to 12.

The invention will be better understood on reading the description that follows, given solely by way of example and in light of the drawings in which.

Figure 1:
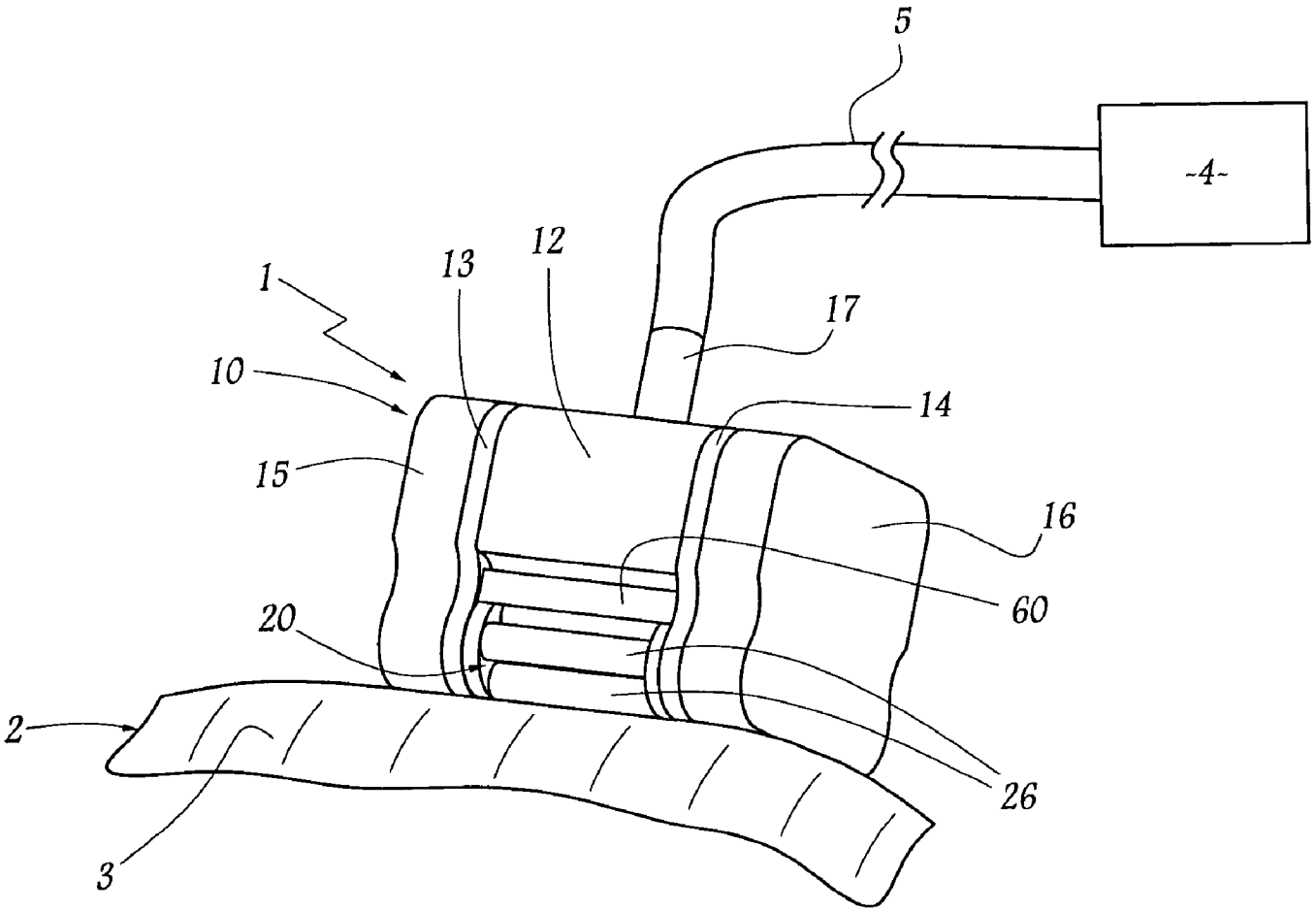
FIG. 1 is a perspective diagrammatic view of a first embodiment of a device according to the invention, applied to a subject.

FIGS. 1 to 7 represent a massage device 1 making it possible to perform "rolling" type massages on a subject 2, that is, massages that make it possible to exert on the skin 3 of this subject a continuous action during which the device simultaneously performs a local pinching of a fold of skin and a progressive displacement of the pinched fold of skin, so as to provoke a "rolling" of this fold of skin.

For convenience, the description below is given by assuming that the device 1 rests on the subject 2 who is in an elongate position, so that the terms "bottom" and "down" designate a direction directed towards the skin 3 of the subject, whereas the terms "top" and "up" correspond to the opposite direction.

The device 1 comprises a rigid casing 10, produced, all or partly, for example in metal, plastic material, etc. This casing comprises a main body 12 of overall parallelepipedal form, flanked at its two longitudinal ends with lateral walls 13 and 14 that extend well below the bottom face 12A of the body 12. On the side opposite to the body 12, each lateral wall 13, 14 is covered by a cover 15, 16. In the assembled state of the device 1, as in FIGS. 1 and 3 to 6, the body 12, the lateral walls 13 and 14 and the covers 15 and 16 are securely joined to each other, for example by added screws. In FIG. 2, the covers 15 and 16 are not represented.

Figure 4:
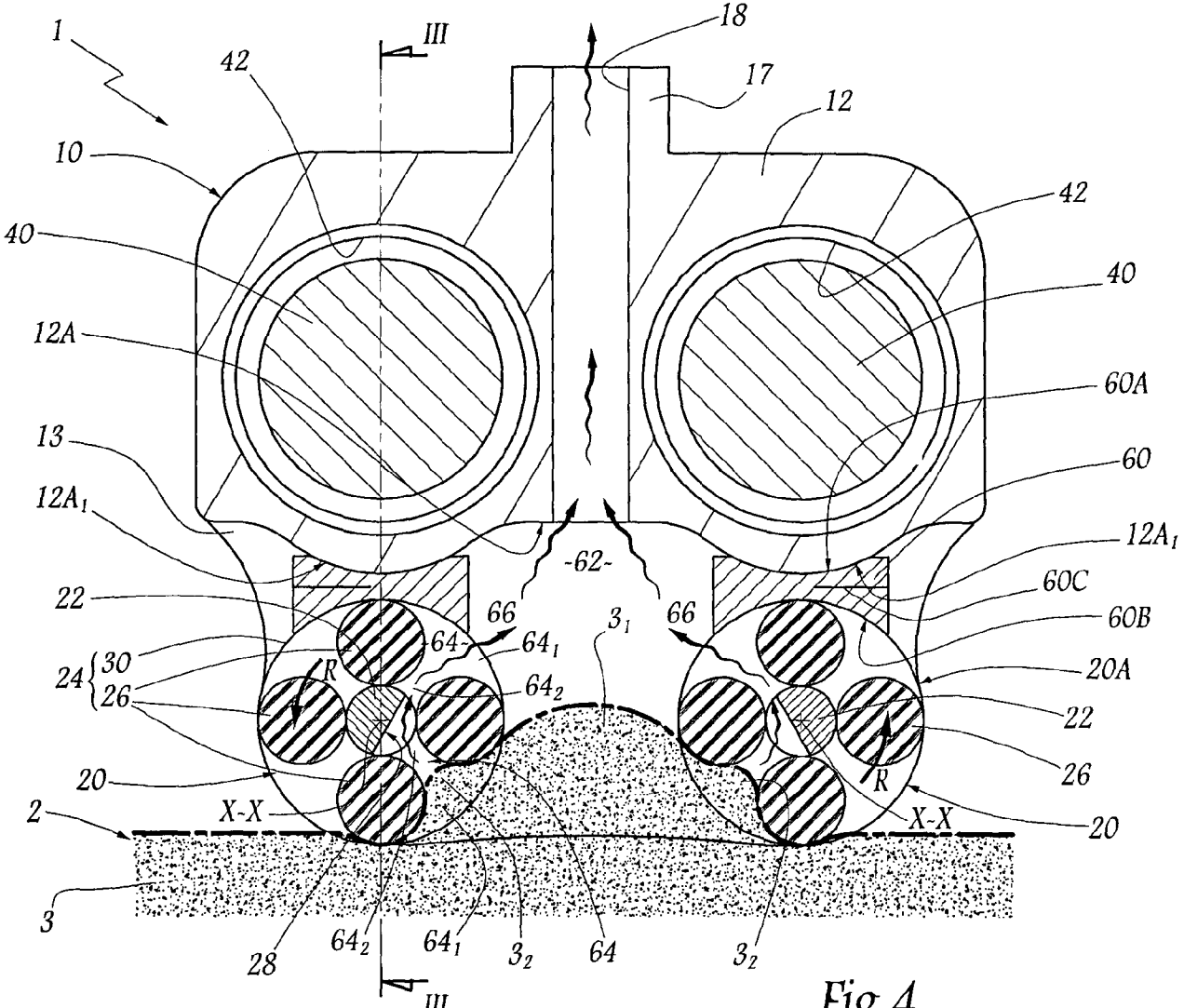
FIG. 4 is a transverse cross section taken along the line IV-IV in FIG. 3, given that the line III-III indicated in FIG. 4 corresponds to the plane of cross section of FIG. 3.
Figure 6:
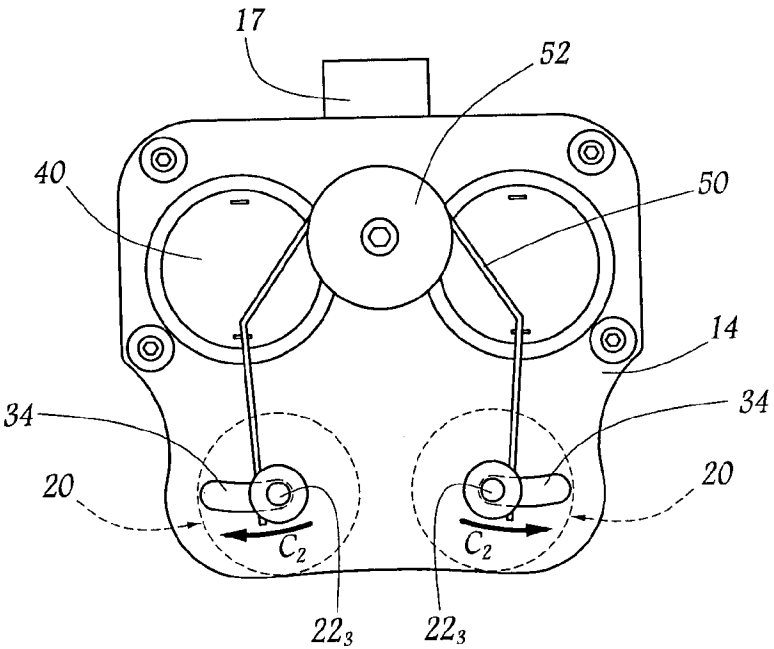
FIGS. 5 and 6 are elevation views along the line V of FIG. 2, respectively illustrating two different operating configurations of the device.
Figure 5:
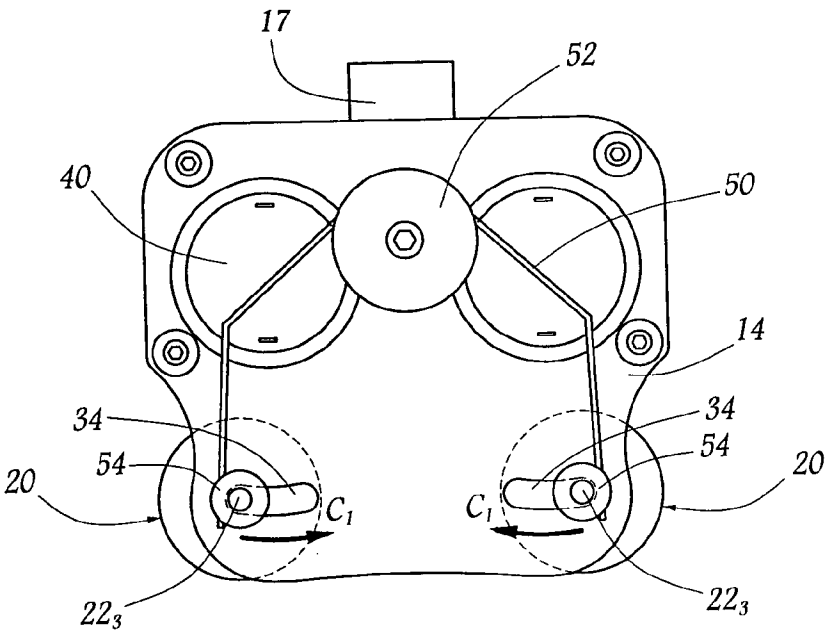

The casing 10 is adapted to be connected to a vacuum source 4, such as a vacuum pump, a depressurized network, an aspiration motor, etc. To this end, the body 12 is provided, on its top side, with a flange 17 for connecting to the vacuum source 4, for example via a pipe 5. This flange opens out into a duct 18 delimited internally by the body 12 and extending as far as its face 12A, as can be seen in FIG. 4.

Figure 3:
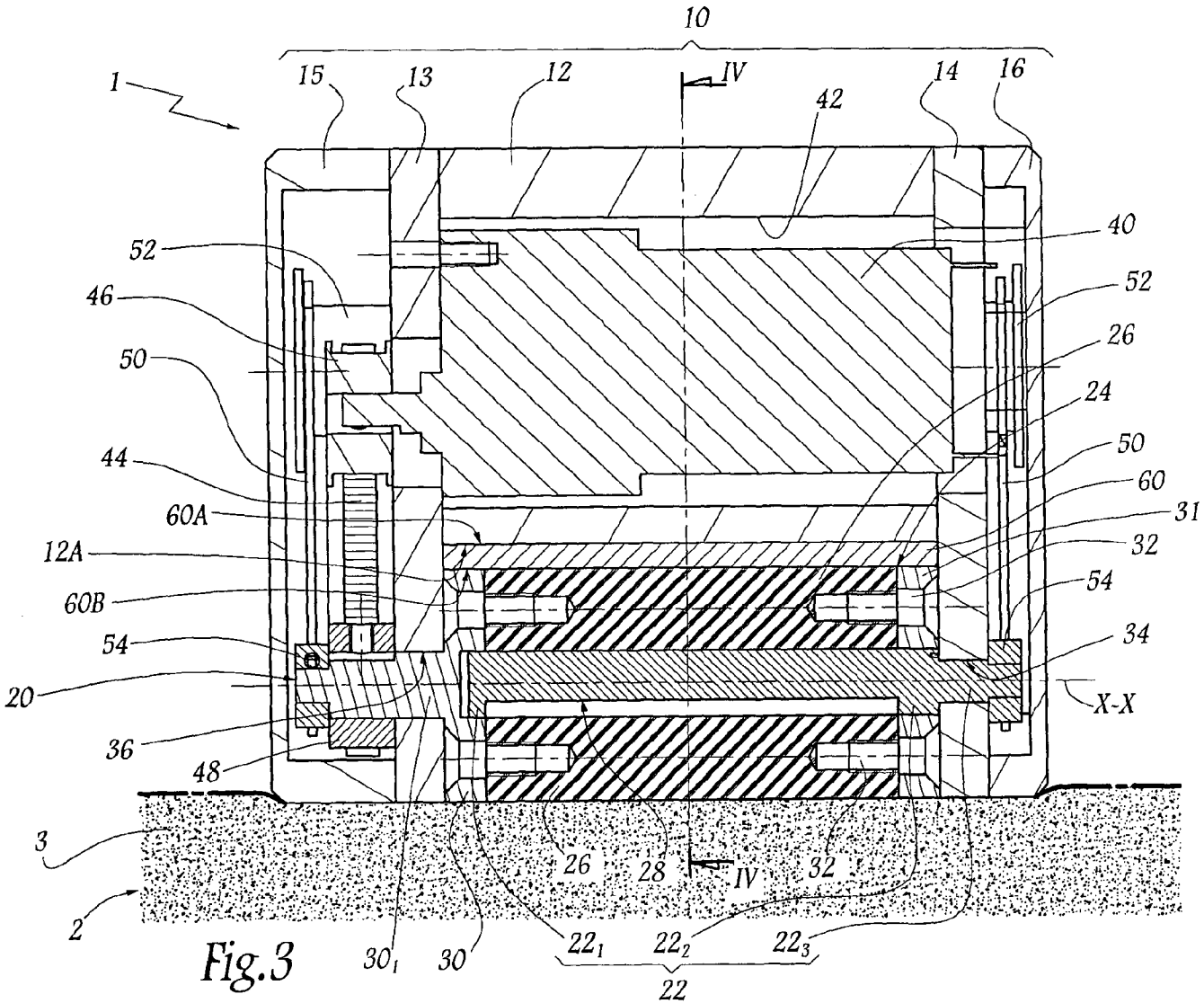
FIG. 3 is a longitudinal cross section of the device of FIG. 1.

The device 1 also comprises two parallel rollers 20 of longitudinal axis X-X. Each roller is mounted inside the casing 10, extending lengthwise between the bottom parts of the lateral walls 13 and 14, with its axis X-X substantially perpendicular to these walls. The rollers are mounted to rotate about their axis X-X relative to the casing, through the intermediary of arrangements described hereinbelow, given that, in service, as represented in FIGS. 3 and 4 in which the skin 3 of the subject 2 is shown transparent, the rollers are intended to be applied to and roll on the skin, with, at each instant, a bottom portion of the periphery 20A of the roller in contact with the skin.

Each roller 20 is associated with an internal shaft 22, extending lengthwise along the axis X-X, being centered on this axis, and comprises a hollow body 24 mounted around the shaft 22 so as to rotate about the axis X-X. As detailed hereinbelow, in the assembled state of the device 1, the shafts 22 are immobile rotation-wise about the axis X-X. This body 24 comprises four cylindrical bars 26 with a circular base and respective central axes substantially parallel to the axis X-X. These bars are distributed substantially uniformly in a direction peripheral to the roller, thus being diametrically opposed in pairs. The radial distance separating two diametrically opposing bars is substantially equal to the diametrical dimension of the shaft 22, so that, as represented in FIG. 4, the peripheral surface of the shaft is tangential, along a sealing line parallel to the axis X-X, to the peripheral surface of each bar 26, except at the level of a longitudinal flat 28 on the shaft where a free space radially separates the shaft and the bars facing this flat.

To maintain the bars 26 around the shaft 22, the body 24 comprises two longitudinal end plates 30 and 31, which present respective overall discoid forms centered on the axis X-X and between which the bars 26 extend lengthwise, with their central axis substantially perpendicular to these plates. The bars 26 are joined to the plates 30 and 31, so that the peripheral face of each roller extends, in its portion radially furthest away from the axis X-X, flush with the peripheral face of the plates. In other words, the peripheral faces of the bars 26 are all inscribed within a cylindrical envelope with a circular base and centered on the axis X-x, including the peripheral faces of the plates and corresponding to the overall periphery 20A of the roller 20.

In practice, the bars 26 are joined to the plates 30 and 31 by means of screws 32 provided at both ends of each bar. The fixing using these screws leaves each bar free to revolve on itself, about its central axis, noting that, as a variant, the bars 26 can be slowed down, even immobilized in rotation relative to the plates 30 and 31.

At each of its longitudinal ends, each shaft 22 forms a journal $\mathbf{22}_1$, $\mathbf{22}_2$ supporting the plates 30 and 31, the flat 28 extending axially between these journals. On the side of the plate 31, the journal $\mathbf{22}_2$ is extended axially by a pin $\mathbf{22}_3$ providing the mechanical link between the shaft 22 and the corresponding lateral wall 14 of the casing 10. This pin $\mathbf{22}_3$ has two opposing flats, received in a tight-fitting manner in a groove 34 delimited by the wall 14, while passing through it axially end to end. The groove 34 is slightly incurved along its length, with a concave curvature facing upward. Since the diameter of the pin $\mathbf{22}_3$ is less than the longitudinal dimension of the groove 34, this pin can be displaced inside the groove along the length of the latter, while being guided by cooperation of the flats of the pin with the bottom and top walls of the groove. Thus, the cooperation of the pin $\mathbf{22}_3$ and of the groove 34 immobilizes the shaft 22 in rotation about the axis X-X, to within an angular play linked to the slight curvature of this groove.

At the axial end opposite to the pin $\mathbf{22}_3$, each plate 30 is extended rigidly by a cylindrical pin $\mathbf{30}_1$ centered on the axis X-X. This pin $\mathbf{30}_1$ is received in a groove 36 delimited by the wall 13 and passing from end to end through the latter. The groove 36 has an incurved elongate form similar to that of the groove 34, so that the pin $\mathbf{30}_1$ is received in the groove 36 while being able to be displaced therein along the length, and while being able to revolve on itself.

To enable a positive rotational drive of the rollers 20, each of these rollers is associated with an electric motor 40, advantageously reversible, the housing of which is received in an associated recess 42 delimited by the casing 10, inside its main body 12. The output shaft of each motor 40 is mechanically linked to the pin $\mathbf{30}_1$ of the corresponding roller 20 by a toothed belt 44, in gear with ribbed pinions 46 and 48 respectively joined to the output shaft of the motor and the pin $\mathbf{30}_1$. In operation, when the motor 40 is supplied with electricity, the rotary movement of its output shaft is transmitted to the body 24 of the roller 20, by, in succession, the pinion 46, the belt 44 and the pinion 48. The body 24 then revolves in rotation about the axis X-X, as indicated by the arrow R in FIG. 4, while being supported by the shaft 22, at its journals $\mathbf{22}_1$ and $\mathbf{22}_2$.

Independently of this rotary movement R, each roller 20 can be displaced relative to the casing 10 by sliding its pins $\mathbf{22}_3$ and $\mathbf{30}_1$ along their associated groove 34, 36. In other words, by sliding in these grooves, the rollers 20 can, while maintaining their substantially parallel axis X-X, be brought closer together or further apart from each other in a direction that is globally radial to this axis X-X, as indicated respectively by the arrows $C_1$ and $C_2$ indicated in FIGS. 5 and 6 for which the cover 16 is removed. The movement apart $C_2$ of the two rollers is controlled by hairpin springs 50 arranged on the outside of the walls 13 and 14; each spring 50 comprises a central part mounted in a tight-fitting manner on a spindle 52 fixed to the corresponding lateral wall 13 or 14, while each free end of the lateral branches of the spring is mechanically linked to each of the rollers 20, through the intermediary of a ring 54 securely linked rotation-wise either with the pin $\mathbf{30}_1$ on the side of the wall 13, or with the pin $\mathbf{22}_3$ on the side of the wall 14. The springs 50 are dimensioned to maintain the rollers 20 normally separated from each other under the action of an elastic stress generated by their branches, that is, to respectively maintain the pins $\mathbf{22}_3$ and the pins $\mathbf{30}_1$ at the ends of the grooves 34 and 36 opposite to one another, as in FIG. 5. In operation, when the two rollers 20 come closer together, the springs 50 are deformed, as far as the extreme configuration represented in FIG. 6, while tending to separate the rollers by an elastic return effect.

The device 1 also comprises two sealing scrapers 60 inserted between each roller 20 and the bottom face 12A of the main body 12. More specifically, the face 12A is not flat, but has, globally facing each roller, surfaces $\mathbf{12}A_1$ bulging downward, globally corresponding to a portion of cylindrical surface with a circular base and of axis parallel to the axis X-X. Each scraper 60 takes the form of an elongate piece, extending lengthwise between the lateral walls 13 and 14 and having top 60A and bottom 60B surfaces corresponding to portions of cylindrical surface with a circular base, respectively complementing the surface $\mathbf{12}A_1$ and the peripheral jacket 20A of the rollers 20.

In the assembled state of the device 1, the scrapers 60 ensure the seal between the rollers 20 and the bottom face 12A of the body 12 of the casing 10, so that this casing defines a treatment chamber 62 delimited, between the rollers, by the face 12A of the body 12 and by the lateral walls 13 and 14. This chamber is thus open downward, between the rollers, whereas it is sealed by the scrapers 60 and by the plates 30 and 31 bearing to slide against the facing faces of the walls 13 and 14.

The massage device 1 is used as follows.

Figure 2:
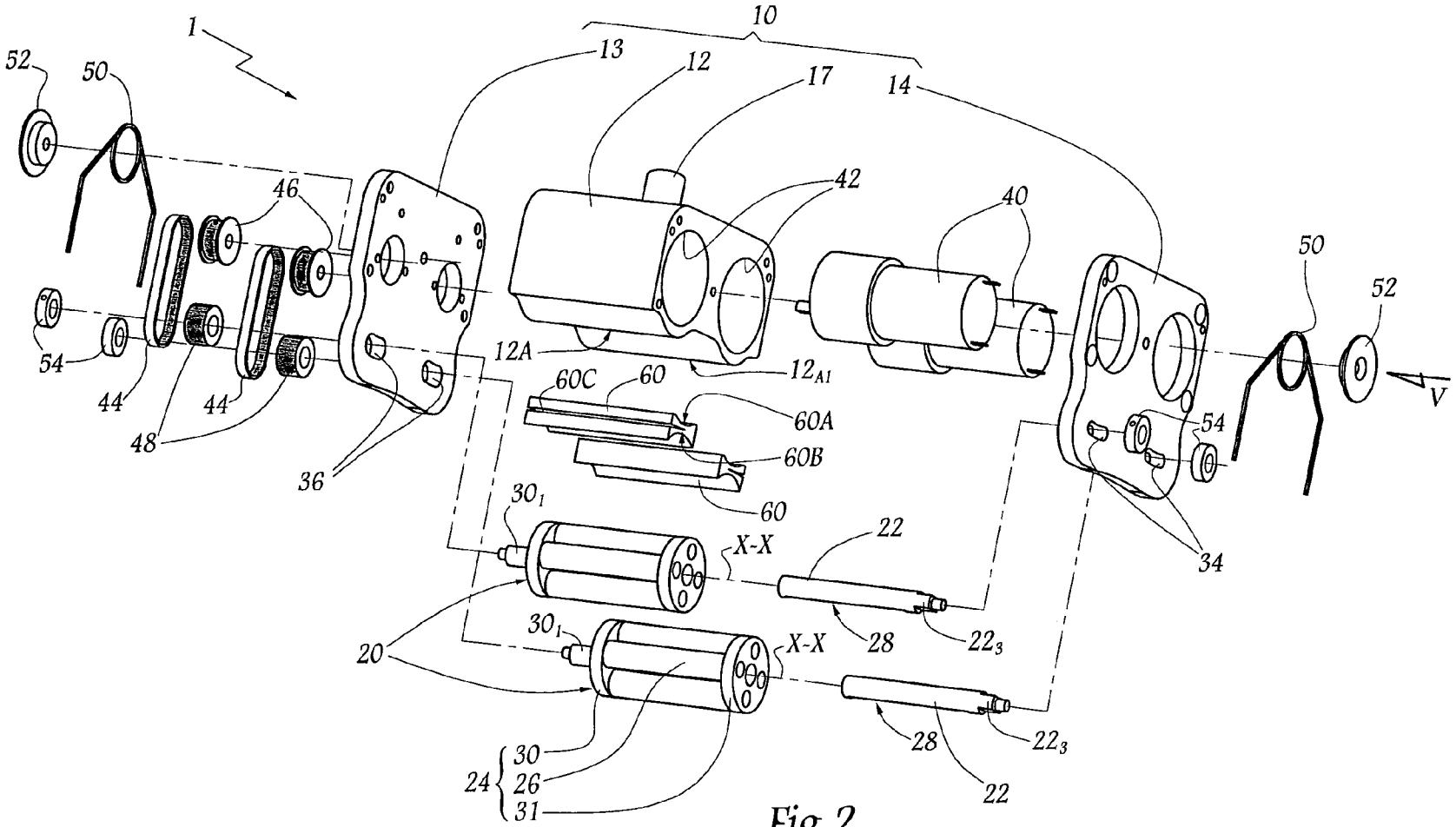
FIG. 2 is a perspective exploded view of the main components of the device of FIG. 1.

The casing 10 is manipulated so that the rollers 20 are applied against the skin 3 of the subject 2 as in FIG. 1. The treatment chamber 62 is then open directly on the skin 3, as represented in FIGS. 3 and 4. By actuating the vacuum source 4, the air contained in the chamber 62 is aspirated through the duct 18, so as to create a partial vacuum in the chamber 62. More specifically, as represented in FIG. 4, the skin 3 is aspirated, both between the rollers 20, by forming a central fold of skin $\mathbf{3}_1$, and, at the level of each roller 20, by forming small lateral folds $\mathbf{3}_2$ in the base areas of the central fold $\mathbf{3}_1$. In practice, the depressurization of the chamber 62 provokes the aspiration of the air contained in some of the free spaces separating the bars 26 in a direction peripheral to the roller, it being noted that the free spaces concerned depend on the angular position of the roller about the axis X-X. As an example, considering the angular position of the roller represented in the left-hand part of FIG. 4, the air is thus aspirated from the free space between the lowest bar and the rightmost bar, as is the air in the free space between the rightmost bar and the topmost bar, it being noted that these two spaces are placed in fluidic communication with one another through the shaft 22, by the free volume corresponding to the flat 28.

More generally, it will be understood that, between two adjacent bars 26, the body 24 of each roller 20 delimits an air aspiration passage 64 which extends overall in a direction radial to the axis X-X. At its outer radial end $\mathbf{64}_1$, each passage opens out onto the peripheral jacket 20A of the roller, whereas its inner radial end $\mathbf{64}_2$ opens out onto the internal shaft 22. Depending on the angular position of the body 24 about the axis X-X, the ends $\mathbf{64}_2$ facing the flat 28 are placed in fluidic communication with one another through this shaft, whereas the ends $\mathbf{64}_1$ the corresponding passages open out, for some, onto the skin 3, forming thereon the lateral fold or folds $\mathbf{3}_2$, and for others into the treatment chamber 62. Thus, as indicated by the undulating arrows 66 in FIG. 4, the skin in contact with the aspirating rollers 20, at the level of the base areas of the central fold $\mathbf{3}_1$, forms the lateral folds $\mathbf{3}_2$ by being aspirated through each roller, the periphery 20A of which is connected to the vacuum source 4 via, in succession, the chamber 62, the duct 18 and the pipe 5. Regarding the passages 64, the ends $\mathbf{64}_2$ of which do not open out at least partially onto the flat 28 but onto the cylindrical peripheral face of the rest of the shaft 22, these passages do not communicate with the vacuum source, via the shaft 22, because the latter blocks in a substantially sealed manner their end $\mathbf{64}_2$. Thus, it will be understood that the shaft 22 forms a means of distributing the vacuum supplied by the vacuum source 4 inside the roller 20.

Simultaneously with the aspiration of air by the vacuum source 4, the rollers 20 can be rotated about their axis X-X, by actuating the electric motors 40. The outer bodies 24 of these rollers then revolve about the axis X-X, making the passages 64 via which the shaft 22 controls the aspiration of air through the rollers 20 follow each other in turn.

The depressurization of the chamber 62 also tends to bring together the rollers 20, by sliding along the grooves 34 and 36, against the elastic forces generated by the springs 50. Thanks to this movement closer together $C_1$, the fold of skin $\mathbf{3}_1$ is pinched between the rollers, as represented in FIG. 4, which corresponds to a configuration in which the pins $\mathbf{22}_3$ and $\mathbf{30}_1$ of each roller occupy a substantially median position along the grooves 34 and 36. The scrapers 60 then maintain the seal between each roller and the bottom face 12A of the body of the casing 12, in particular in movements closer together and further apart of the rollers by the surfaces 60A and $\mathbf{12}A_1$ sliding one against the other in a sealed manner, including when each roller 20 is driven to rotate, by the surface 60B and the peripheral jacket 20A sliding one against the other in a sealed manner.

Figure 7:
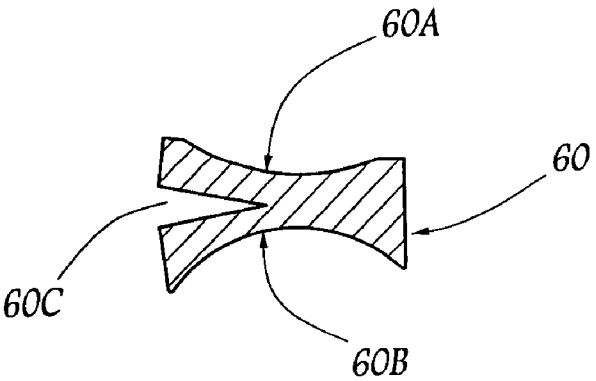
FIG. 7 is a transverse cross section of one of the components of the device, on the plane VII of FIG. 2.

To this end, according to a particularly practical embodiment, each scraper 60 is manufactured, in particular by injection of a plastic material, in the form of an elongate piece having a transverse section conforming to FIG. 7, that is, with a lateral slot 60C with V-section. In the non-assembled state of this piece, as in FIG. 7, the edges of the slot 60C are normally separated from each other in a vertical direction, by an appropriate molding of the piece. When the scrapers are assembled with the rest of the device 1, the slot is partially, even totally, closed on itself, as represented in FIG. 4, its edges having, however, a tendency to move apart from one another to return to their configuration on leaving the mold, by elastic return of the material forming the scraper. This elastic return effect reinforces the sealing of the sliding contacts at the level of the surfaces 60A and 60B, while accommodating any assembly plays between the rollers 20 and the casing 10.

Figure 10:
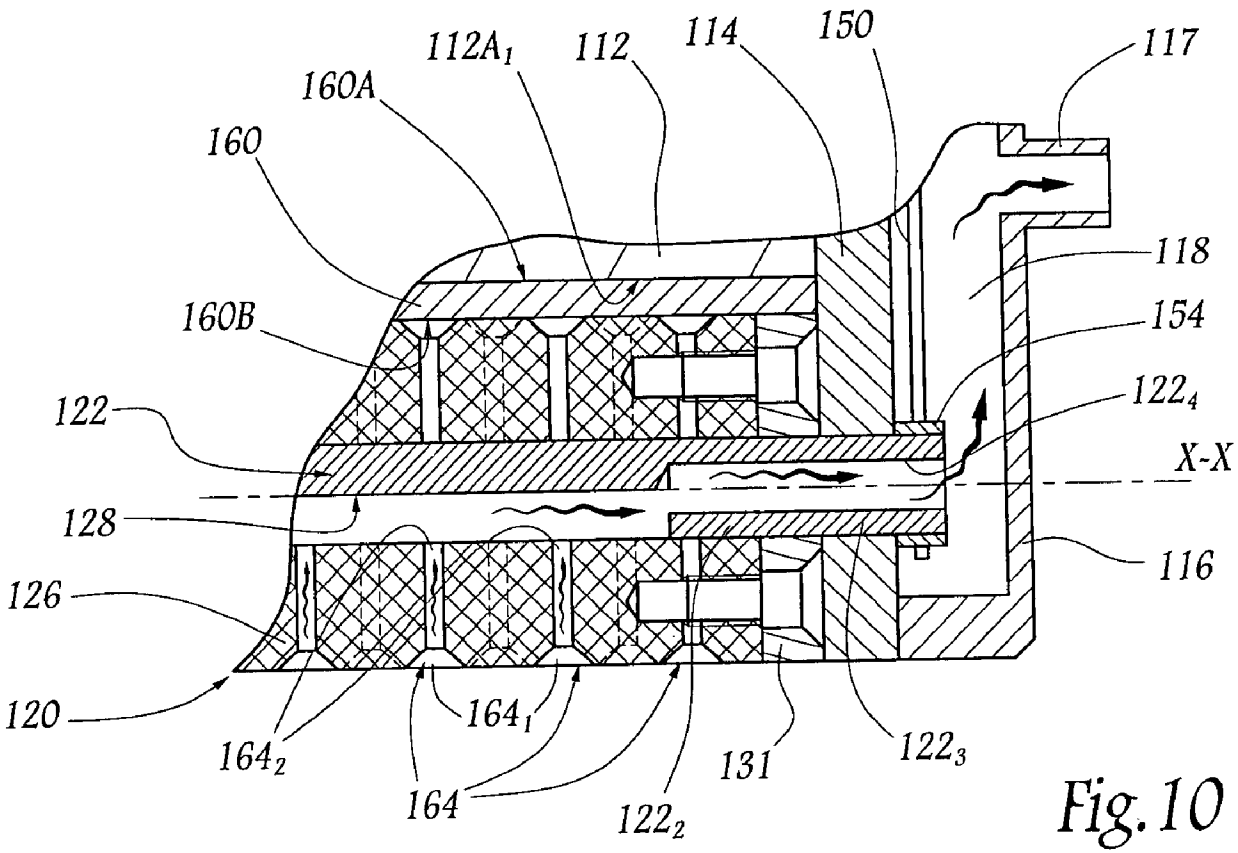
FIG. 10 is a partial cross section along the line IX-IX of FIG. 9.
Figure 8:
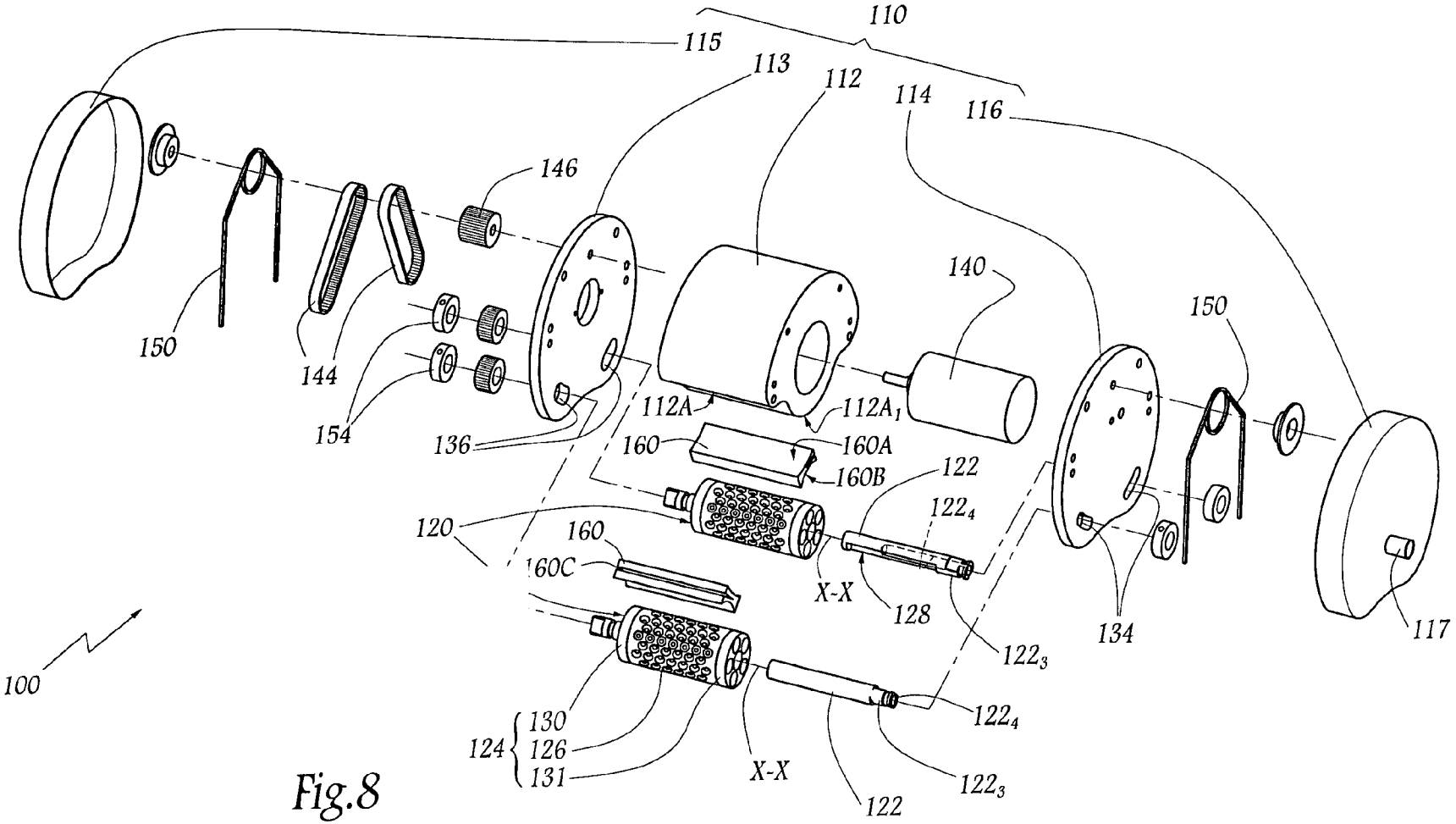
FIG. 8 is a view similar to FIG. 2, illustrating a second embodiment of the device according to the invention.
Figure 9:
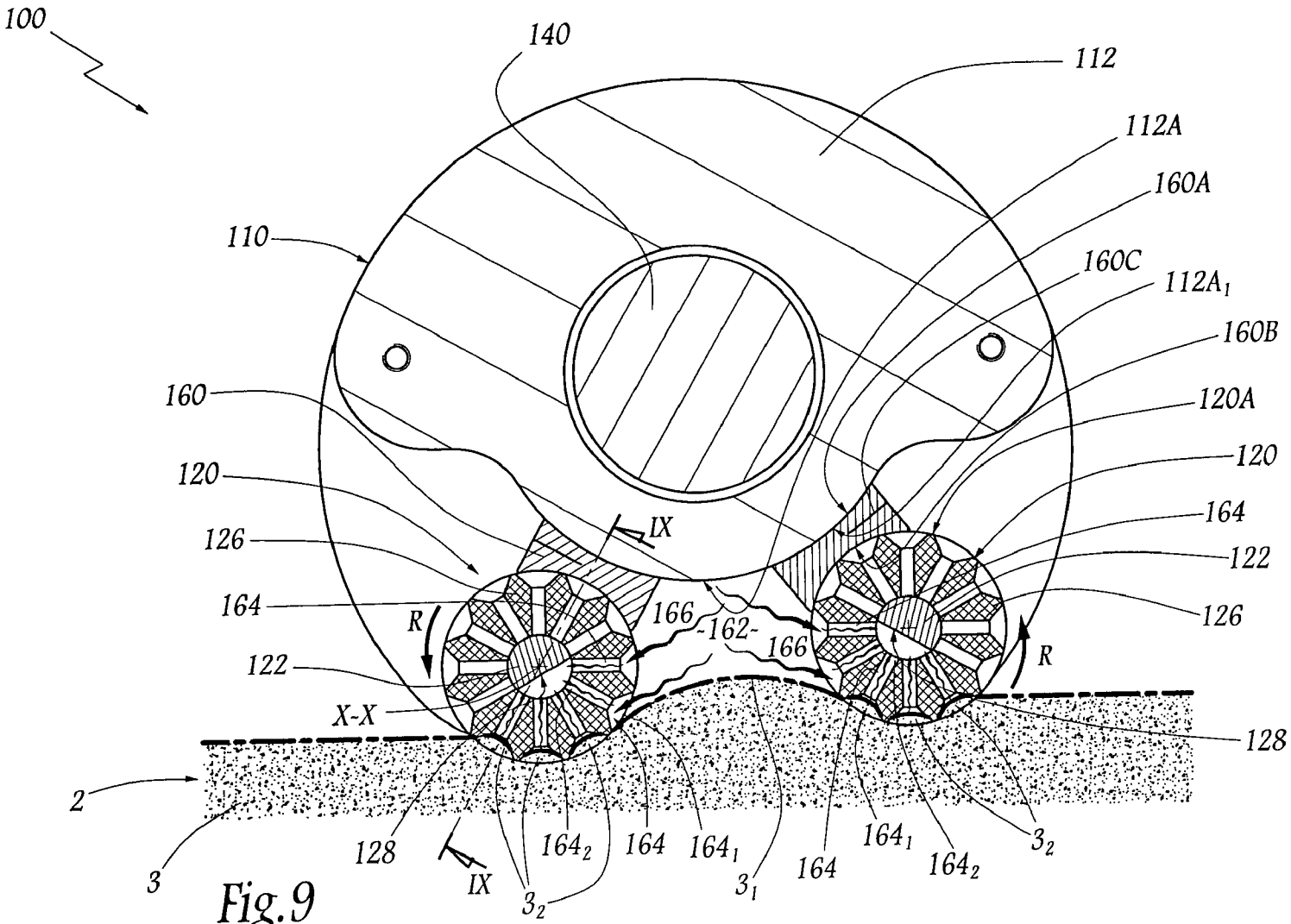
FIG. 9 is a transverse cross section of the device of FIG. 8.

FIGS. 8 to 10 represent another embodiment of a massage device 100. This device 100 comprises a large number of components that are functionally identical to those of the device 1 of FIGS. 1 to 7, these components being, for convenience, designated, hereinafter and in the figures, by the same numeric references as those used for the device 1, preceded by the digit 1. Thus, the device 100 comprises, among other things, a casing 110 and two rotary rollers 120.

The device 100 is essentially distinguished from the device 1 by three aspects. The first aspect relates to the overall geometry of its casing 110, inasmuch as this casing 110 is smaller than the casing 10, with constant roller size. This size difference offers in particular an advantage linked to the use of the devices 1 and 100: whereas the device 1 is preferably manipulated by two hands given the size of its casing 10, the casing 110 of the device 100 is small enough to be gripped in the hollow of a single hand, so that a person can simultaneously manipulate two devices 100, with a device in each hand. To this end, the top face of the main body 112 of the casing 110 bulges upward, to facilitate taking hold of and manipulating the device 100. Furthermore, in practice, the flange 117 for connecting to the vacuum source 4 is not provided on the top side of the casing 110, but extends from the lateral cover 116, this flange 117 thus opening out directly into the interstitial volume 118 delimited between this cover 116 and the adjacent lateral wall 114, as represented in FIG. 10.

In practice, to limit the bulk of the casing 110, the device 100 includes only a single motor 140, the output movement of which is transmitted at the same time to both rollers 120, via two toothed belts 144 in gear with one and the same motor output pinion 146.

Furthermore, compared to the body 12 of the casing 10, the surfaces $\mathbf{112}A_1$, against which the top surfaces 160A of the scrapers 160 bear and slide, extend in the extension of one another without discontinuity, in the form of one and the same portion of overall cylindrical surface.

According to another aspect of difference between the devices 1 and 100, the outer body 124 of each aspirating roller 120 does not include a peripheral succession of bars, like the bars 26 for the aspirating rollers 20 of the device 1, but comprises a single-piece tubular sleeve 126 centered on the axis X-X of the roller and extending lengthwise between the end plates 130 and 131, which have respective structures similar to those of the plates 30 and 31. To allow the air to be aspirated through the sleeve 126, the latter is radially perforated by a plurality of orifices, distributed both over the length of the sleeve and on its periphery. These orifices thus form radial aspiration passages 164, the outer end $\mathbf{164}_1$ of which opens out onto the peripheral face 120A of the sleeve 126, whereas the inner end $\mathbf{164}_2$ of each passage opens out onto the shaft 122 internal to the sleeve.

Advantageously, the end $\mathbf{164}_1$ of each passage 164 is flared towards the outside, so as to distribute the aspiration effect generated at this end over a larger area of skin.

According to a third aspect of difference between the devices 1 and 100, the air aspirated through each aspirating roller 120 by the passages 164 opening out onto the skin of the subject does not pass through the treatment chamber 162 delimited by the casing 110 between the rollers, but is directly evacuated by the shaft 122. To this end, as represented in detail in FIG. 9, the journal $\mathbf{122}_1$ and the end pin $\mathbf{122}_3$ of this shaft are hollowed out internally, so as to delimit a bore $\mathbf{122}_4$ centered on the axis X-x and opening out onto, on an axial side, the flat 128 and onto, on the other axial side, the outside of the shaft, inside the interstitial volume 118 between the wall 114 and the cover 116.

In this way, when the vacuum source 4 is actuated, the volume 118 is depressurized, provoking the aspiration of the air at the level of the flat 128, via the bore $\mathbf{122}_4$. As represented in FIG. 9, depending on the angular position of the sleeve 126 about the axis X-X, the shaft 122 controls the aspiration of the air contained in the passages 164, the ends $\mathbf{164}_2$ of which are facing the flat 128: for the passages of which the end $\mathbf{164}_1$ is in contact with the skin, this aspiration provokes the localized gripping of the area of skin covered by this end, forming the lateral folds of skin $\mathbf{3}_2$, whereas for the passages of which the end $\mathbf{164}_1$ opens out into the treatment chamber 162, the aspiration provokes the depressurization of this chamber, which produces the treatment by aspiration of the central fold of skin $\mathbf{3}_1$, and the pinching of this fold by the bringing together of the rollers 120 by sliding in the lateral grooves 134 and 136. The flow of the air aspirated in this way by these various passages 164 of the aspirating rollers is indicated by the undulating arrows 166 in FIG. 9.

Figure 11:
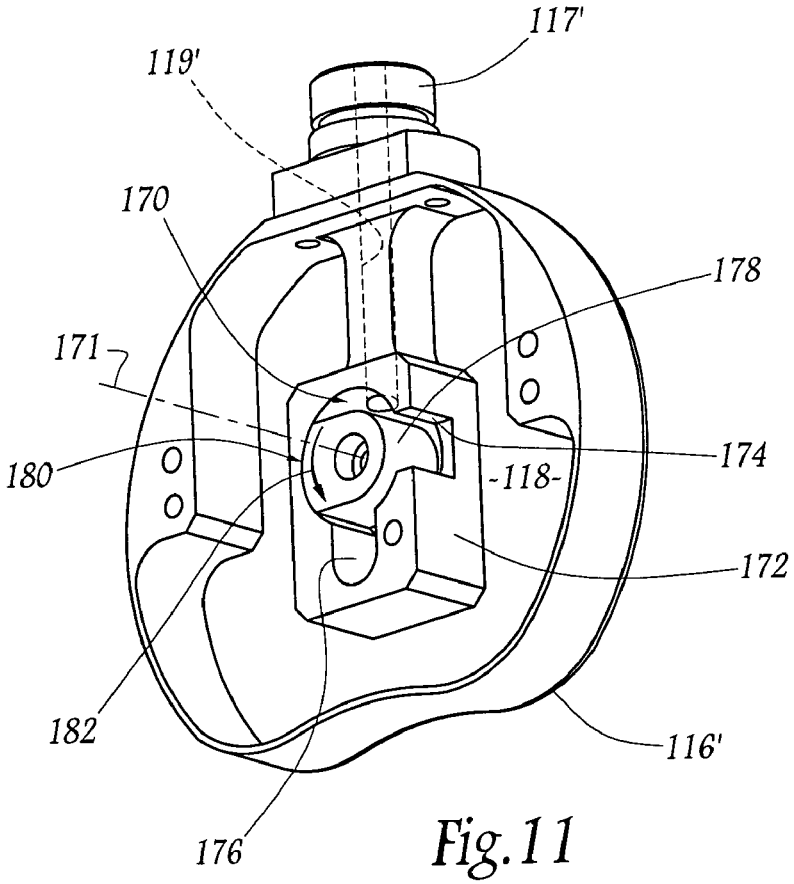
FIGS. 11 and 12 are perspective views of a variant of two different parts of the device according to the second embodiment.

As an optional arrangement, a cover 116', a variant of the cover 116, is represented in FIG. 11. Unlike the cover 116, its flange 117' for connecting to the vacuum source 4 does not extend laterally towards the outside relative to the cover 116', but is provided on the top side of this cover. Furthermore, rather than opening out directly into the interstitial volume 118 delimited between the cover 116' and the wall 114, the flange 117' opens out into a duct 119' delimited internally by the cover 116'. At the opposite end from the flange 117', this duct 119' opens out into the internal volume 170 of a distribution body 172 joined to the inner face of the cover 116', for example by being made directly as one piece with this face. The volume 170 has a cylindrical form, with a circular base and centered on an axis 171. This axis 171 is parallel to the axes X-X of the rollers 120 when the cover 116' is joined to the wall 114.

The distribution body 172 has a thickness substantially equal to that of the cover 116', so that, when the latter is joined to the wall 114, the axial end of the volume 170, facing towards the wall 114, is closed in a substantially sealed manner by this wall 114.

As clearly visible in FIG. 11, the volume 170 communicates fluidically with the volume 118 via a passage 174 delimited by one of the walls of the distribution body 172 radially to the axis 171. This passage 174 is offset by approximately 90° about the axis 171 relative to the opening of the duct 119' into the volume 170.

Furthermore, unlike the duct 119' relative to the axis 171, the volume 170 communicates fluidically with a void 176 hollowed out in the distribution body 172 from the volume 170. When the cover 116' is joined to the wall 114, this void 176 does not open out into the volume 118, but into an orifice, not represented in the figures, provided through the wall 114, into the chamber 162.

Inside the volume 170, the distribution body 172 is equipped with a closure member 178 mounted to rotate about the axis 171. A part, not visible in FIG. 11, of this closure member 178 extends to the outside of the cover 116', opposite the wall 114, so that the closure member can be actuated from outside, to be driven rotation-wise about the axis 171 by a user.

The lateral face of the closure member 178 is radially distant from the wall delimiting the volume 170, except in a portion 180 configured as a cylinder portion complementing the volume 170. In service, the closure member 178 can be displaced, by rotation about the axis 171, between four successive positions, namely:

- a first position, illustrated in FIG. 11, in which the duct 119', the passage 174 and the void 176 are in free fluidic communication with one another, through the intermediary of the volume 170; in this way, the vacuum supplied by the pump 4 circulates, in the volume 170, around the closure member 178 between the duct 119' and, on the other hand, the volume 118 and therefore the bore $\mathbf{122}_4$ provided at the end of the shaft 122, via the passage 174, and, on the other hand, the chamber 162, via the void 176 and the above-mentioned orifice which passes right through the wall 114;
- a second position, obtained by a rotation of 90° of the closure member 178 from its first position, in the direction of the arrow 182 indicated in FIG. 11; in this second position, the portion of the surface 180 isolates, in a sealed manner, the volume 170 and the void 176 from each other, so that the vacuum supplied by the pump 4 can no longer circulate into the chamber 162 through the wall 114, while circulating into the volume 118, via the passage 174; thus, in this second position of the closure member, the vacuum circulates in the device 100 in a manner identical to that indicated by the arrows 166 in FIGS. 9 and 10, as explained above;
- a third position, obtained by a rotation of 90° of the closure member 178 from its second position and according to the arrow 182; in this third position, the portion of surface 180 isolates, in a sealed manner, the volume 170 and the passage 174 from each other, so that the vacuum originating from the duct 119' no longer feeds the volume 118 via the passage 174, while this vacuum circulates around the closure member into the void 176, from which it directly feeds the chamber 162, through the wall 114; and
- a fourth position, obtained by a rotation of 90° of the closure member 178, from its third position and according to the arrow 182; in this fourth position, the portion of surface 180 isolates, in a sealed manner, the volume 170 and the duct 119' from each other, so that the vacuum supplied by the pump 4 no longer circulates in the device 100.

It will thus be understood that the closure member 178 makes it possible to select a vacuum circulation mode in the device 100. In practice, in its first position, the closure member controls the circulation of the vacuum between the pump 4 and at the same time, the end orifice $\mathbf{122}_4$ of the shaft 122 and the chamber 162, directly, that is, without having to pass through the interior of the rollers 120. On the other hand, in its second and third positions, the closure member 178 controls the circulation of the vacuum exclusively between, directly, the pump 4 and, respectively, the end orifice $\mathbf{122}_4$ and the treatment chamber 162. In its fourth position, the closure member 178 prevents the vacuum from reaching the rollers 120, so that the device 100 can thus in particular be cleaned or stored.

By being able to combine the circulation of the vacuum from the treatment chamber 162 and the bored end of the shaft 122, it is possible to make the vacuum act on the skin of the subject differently compared to when the vacuum circulates either exclusively from the chamber, or exclusively from the bored end of the shaft. Thus, by changing the position of the closure member 178, three different types of skin treatment are available.

Figure 12:
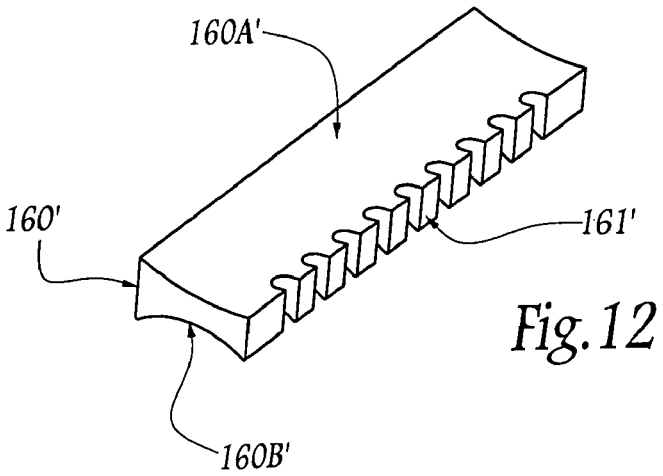

FIG. 12 represents another optional arrangement of the device 100, relating to the scraper 160. A scraper variant 160' is thus represented on its own in FIG. 12. This variant is essentially distinguished from the scraper 160 by the presence of a serration 161' formed in the lateral face of the scraper 160', facing away from the chamber 162. The serration 161' consists of a succession of teeth separated from each other by notches which link together the top 160A' and bottom 160B' surfaces of the scraper and which extend in extension of the openings 1642 of the passages 164 when the roller 120 rotates. In service, the serration 161' makes it possible to return air to the passages 164 originating from the chamber 162, without waiting for the openings $164_2$ of these passages to be brought, by rotation of the roller 120, above the surface 160B'. The vacuum trapped in the passages 164 originating from the chamber 162 is thus more quickly repressurized, which limits the effect of resistance to the rotational drive of the roller, created by this trapped vacuum, without compromising the sealing provided by the scraper 160'.

Various arrangements and variants of the massage devices 1 and 100 described hereinabove can also be envisioned. By way of examples:

- the aspects of difference between the devices 1 and 100 can be only partially combined; thus, for example, the casing 10 can receive the rollers 120, a single motor 40 can be provided in the casing 10, etc.;
- the circulation of the vacuum in the casing 10, 110 to the chamber 62, 162 and/or to the end bore $122_4$ of the shaft 122 can be produced by various arrangements of the casing, in particular through the body 12, 112 and/or the lateral walls 13, 14, 113, 114 and/or the covers 15, 16, 115, 116; and, by way of a variant that is not represented of the device 100, the vacuum can circulate from the vacuum source 4 through the body 112 to at least one of the surfaces $112A_1$ so as to aspirate, through the corresponding scraper 160 provided with a through orifice linking its surfaces 160A and 160B, the air from at least some of the passages 164, the ends $164_1$ of which open out onto this scraper, it being understood that, because of the flat 128, this aspiration provokes the aspiration of the air contained in the passages, the ends $164_1$ of which open out, on the one hand, into the chamber 162 and, on the other hand, onto the skin of the subject;
- the extent and the angular position about the axis X-X of the flat 28, 128 can be modified, to affect the flow of air at the ends $64_2$, $164_2$ of the aspiration passages 64; 164;
- the motorization of the devices 1 and 100 is optional, inasmuch as the motors 40 and 140 can be eliminated, the rollers 20, 120 then being driven to rotate about their axis by rolling against the skin of the patient, when the casing 10, 110 is displaced manually; in this case, the rotation of the rollers remains easy to obtain, inasmuch as, since the aspirating rollers locally grip the skin and are thus pressed flat against it by a kind of sucker effect, they adhere sufficiently to the skin to work without skidding, or slipping, without there being any need for excessive vacuum levels, which would render the device difficult to handle for the masseur and painful for the subject;
- the number and the disposition of the passages 64, 164 by which the air is aspirated through the rollers 20 and 120 can be modified; for example, as a variant that is not represented of the roller 20, the outer body 24 can comprise more or fewer than four bars 26;
- rather than providing a strictly circular section for the openings $164_2$ of the passages 164, this section can take the form of a droplet, bulging on the side of the roller 120, where the latter advances on the skin;
- the casing 10, 110 can be arranged at the distal end of a handle, inside which the vacuum circulates from the vacuum source 4 to the casing; in this case, the connecting flange 17, 117 or 117' is provided inclined from the vertical, to extend in the extension of this handle; optionally, the handle can also incorporate means, in particular electronic means, of detecting the direction in which the masseur wishes to advance the casing against the skin of a subject; in practice, the aspirating rollers generate, at the beginning of their rotation, a low resistance torque, due to the gripping by aspiration of the skin by the roller; this resistance can be detected to deduce the direction of rotation in which the rollers must be driven and to control the electrical power supply to the motorization 40, 140 in a corresponding way; and/or
- the vacuum source 4 can be designed to provide a vacuum with a constant intensity or with a cycle of variable intensity, producing a sensation of blows on the skin treated by this vacuum via the device 1 or 100.

The invention claimed is:

1. A device for treating connective tissue of skin of a subject, associated with a vacuum source, comprising two parallel rollers to work the skin of the subject, mounted in a casing to rotate about their respective axis, wherein at least one of the rollers is hollow and delimits aspiration passages transverse to the axis of the roller, these aspiration passages each having an outer end opening out on a periphery of the roller, and an inner end adapted, at least when, during the rotation of the roller, the outer end of the passage is directed towards the skin being worked by the roller, to be connected to the vacuum source by a control means with which the roller is internally fitted and which is borne by the casing, and these aspiration passages being distributed on the periphery of the roller so that, for each position of the roller about its axis, at least one of the aspiration passages has its outer end directed towards the skin being worked by the rollers and has its inner end placed in fluidic communication by the control means with an inner end of at least one other of the aspiration passages, an outer end of the at least one other aspiration passage opens out into a free volume defined inside the casing.

2. The device as claimed in claim 1, wherein said at least one of each roller comprises longitudinal bars parallel to the axis of the roller and distributed around the periphery of the roller, being spaced relative to each other in such a way as to form between them the aspiration passage.

3. The device as claimed in claim 1, wherein said at least one of each roller comprises a tubular sleeve centered on the axis of the roller and pierced with orifices forming the aspiration passages, these orifices extending in a substantially radial manner to the axis of the roller and being distributed in the axial dimension of the sleeve.

4. The device as claimed in claim 1, wherein the control means comprises a shaft supporting the roller, about which the roller rotates on itself and which features a flat by which the inner end or ends of the aspiration passages facing this flat are placed in fluidic communication with the vacuum source.

5. The device as claimed in claim 1, wherein the control means delimits, at one of its axial ends, a through orifice via which a vacuum circulates between the vacuum source and an inside of the roller.

6. The device as claimed in claim 1, wherein the free volume is adapted to circulate a vacuum between the vacuum source and the periphery of the roller.

7. The device as claimed in claim 6, wherein the control means delimits, at one of its axial ends, a through orifice via which the vacuum circulates between the vacuum source and an inside of the roller, and wherein the device also comprises a selection means, which can be actuated from outside the casing and adapted to control circulation of the vacuum, without passing through the aspiration passages, between the vacuum source and either exclusively the through orifice, or exclusively the free volume, or cumulatively this through orifice and this free volume.

8. The device as claimed in claim 1, wherein the free volume includes a treatment chamber delimited by the casing between the rollers and open on the skin worked by the rollers.

9. The device as claimed in claim 8, wherein the treatment chamber is sealed, between each roller and a face of the casing facing the skin worked by the rollers, by a scraper featuring, on one hand, a sealing surface against which the periphery of the roller slides during the rotation of an opposing sealing surface and, on another hand, the opposing sealing surface pressed against said face of the casing.

10. The device as claimed in claim 9, wherein at least one of the scrapers or each scraper is provided with a through orifice which links the two sealing surfaces and via which a vacuum circulates between the vacuum source and the periphery of the corresponding roller.

11. The device as claimed in claim 1, wherein the device also comprises electric motorization means adapted to rotate at least one of the rollers.

12. The device as claimed in claim 1, wherein the rollers are adapted to move closer together and further apart from each other in a direction generally radial to their axis, by sliding relative to the casing.

* * * * *

UNITED STATES PATENT AND TRADEMARK OFFICE

CERTIFICATE OF CORRECTION

PATENT NO. : 8,348,866 B2
APPLICATION NO. : 12/305587
DATED : January 8, 2013
INVENTOR(S) : Gianfranco Tudico It is certified that error appears in the above-identified patent and that said Letters Patent is hereby corrected as shown below:

Title Page, item 73 Assignee: should read:

Louisin Research and Development Limited, Dublin, Ireland

Signed and Sealed this
Twenty-sixth Day of February, 2013

Teresa Stanek Rea
*Acting Director of the United States Patent and Trademark Office*